United States Patent [19]

Butterfield et al.

[11] 4,072,331

[45] Feb. 7, 1978

[54] DOOR LATCH HAVING THREE-WAY ACTUATION MEANS

[75] Inventors: Max E. Butterfield, Peoria; Robert M. Alt, Washington; James E. March, Princeville, all of Ill.

[73] Assignee: Caterpillar Tractor Co., Peoria, Ill.

[21] Appl. No.: 700,271

[22] Filed: June 28, 1976

[51] Int. Cl.[2] ..... E05C 15/02

[52] U.S. Cl. ..... 292/173; 292/92; 292/175; 282/254; 292/DIG. 65

[58] Field of Search ..... 292/173, 92, 145, 254, 292/255, 175, DIG. 65, 279, 174; 70/92, 279

[56] References Cited

U.S. PATENT DOCUMENTS

| | | | |
|---|---|---|---|
| 790,791 | 5/1905 | Jones | 292/173 |
| 1,171,690 | 2/1916 | Allmand | 292/173 |
| 1,453,308 | 5/1923 | Dillistone | 292/255 |
| 1,655,840 | 1/1928 | Nichin | 70/92 |
| 1,834,819 | 12/1931 | Beeler | 292/255 |
| 2,094,369 | 9/1937 | Millice | 292/DIG. 65 |
| 2,682,763 | 7/1954 | Williams | 292/175 X |

FOREIGN PATENT DOCUMENTS

| | | | |
|---|---|---|---|
| 383,817 | 1/1965 | Switzerland | 70/92 |
| 664,310 | 1/1952 | United Kingdom | 292/173 |

*Primary Examiner*—Roy D. Frazier
*Assistant Examiner*—Rodney H. Bonck
*Attorney, Agent, or Firm*—Wegner, Stellman, McCord, Wiles & Wood

[57] ABSTRACT

A latch is provided for a door of a cab of a vehicle, such as a track loader, or the like. The latch is provided with external actuating means, internal actuating means and a third override actuating means, the third override actuating means being operative even though either or both of the internal and external actuating means are inoperative.

4 Claims, 2 Drawing Figures

DOOR LATCH HAVING THREE-WAY ACTUATION MEANS

BACKGROUND OF THE INVENTION

1. Field of the Invention

This invention relates to a latch for a door of a vehicle and, more particularly, to a latch having three independent actuating members.

2. Description of the Prior Art

In vehicles, such as earthmoving equipment, it is not uncommon for the cabs to be high or relatively inaccessible from the ground, necessitating an outside door latch that can serve both as a hand hold to assist in pulling an operator up from the ground and, at the same time, can serve as a door actuator. Likewise, such vehicles do, on occasion, encounter emergency situations where an operator on the inside of the cab mut be able to actuate an internal handle quickly to permit a rapid exit from the cab. Due to the relatively rough use afforded the internal and external actuating means, occasionally one or both such means become inoperative necessitating some additional actuating means for permitting the cab door to be opened, particularly from the inside.

Currently, there are in existence devices, such as shown in U.S. Pat. No. 1,417,239, that permit both internal and external actuation of a latch, but with no latch override (or third) actuating means. In another piece of prior art, such as shown in U.S. Pat. No. 1,806,940, there is provided an external actuating lever with an internal actuating member acting directly on the latch, but this device lacks a regular internal actuating lever. Still a third and a fourth piece of prior art, such as shown in U.S. Pat. Nos. 1,845,646 and 1,908,958, have internal and external actuating levers with means for deactivating the external actuating lever while permitting the internal actuating lever to continue to operate. However, these devices still do not provide an override actuating means which can be operated from within, independent of either of the internal or external actuating lever.

SUMMARY OF THE INVENTION

An improved latch device is provided which has both an internal and an external actuating lever operating on a unitary latch bolt or bar. The latch device includes a direct connection to the latch bolt or bar such that actuation thereof will release the latch bolt or bar without interference from either of the internal and/or external actuating levers.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
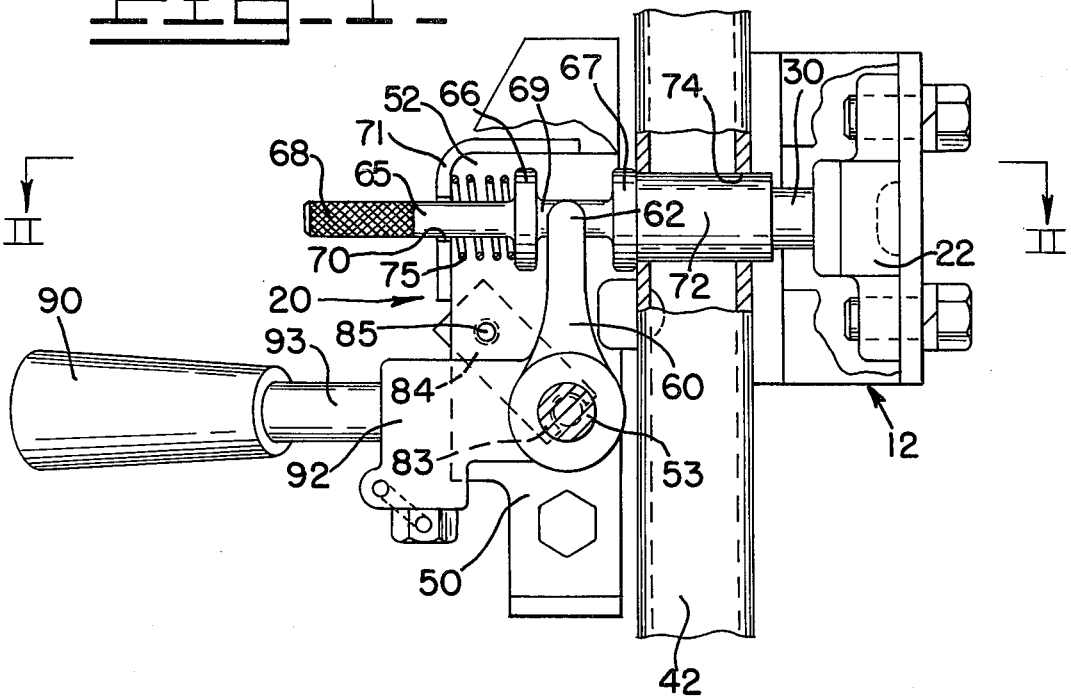
FIG. 1 shows an elevational view with the door panel broken away illustrating the operative parts of our improved latching arrangement.

Referring to the drawings wherein is illustrated a preferred form of our invention, a vehicle frame 10 is shown having a strike portion 12 attached thereto. A door panel 14, shown broken away in FIG. 1 and shown only partially in section in FIG. 2, has mounted along the edge thereof our improved latching device 20. The strike portion 12 includes a notched latch plate 22 in line with an opening 24 and is such that the latch or strike bar 30 will pass through the opening 24 and in engagement with the latch plate 22 when the door 14 is closed.

The door includes a panel 40 welded, or otherwise secured, to a bead 42, to which is attached a resilient seal 44. When the door 14 is closed with the latch bar 30 engaging with the latch plate 22, the resilient seal 44 carried by the door bead 42 engages with the frame 10 of the vehicle to effect a seal between the door and the frame. Bolted, welded or otherwise secured to the door panel 14 is the latch device 20 which includes a base plate 50 having a pair of spaced apart, upstanding wall portions 51,52 through which a shaft 53 passes. The shaft 53 extends through an opening 54 in the door panel and is supported for rotation in the portions 51,52 of the base plate 50. A bifurcated lever 60 is keyed to the shaft 53 between the wall portions 51,52 of the base 50 and has a pair of upstanding, spaced apart fingers 61,62 aligned with each other along an axis parallel to the axis of the shaft 53. The lever 60 is adapted to be rotated through a relatively small arc about the axis of the shaft 53.

The striker bar 30 is connected to an elongate rod 65 having a pair of axially spaced apart, transversely enlarged contact members or bumpers 66,67 and a remote knurled end portion or handle 68. The bumpers 66,67 are separated by a spindle or midportion 69 and are disposed on opposite sides of the bifurcated fingers 61,62 of the lever 60 in position to be contacted by said fingers upon said lever 60 being rotated in one direction or the other. The knurled portion or handle 68 of the rod 65 extends through an aperture 70 in a cover plate 71 which extends across the space between the tops of the wall portions 51,52 and around and over the back of said wall portions 51,52 of the base plate 60. The rod 65 is in axial alignment with the striker bar 30 and, to all intents and purposes, is a one-piece member.

The striker bar 30 passes through a bearing sleeve 72 secured in an opening 74 formed through the bead 42 surrounding the door. The striker bar 30 is guided by the sleeve 72 for axial movement relative thereto. A compression spring 75 encircles the rod 65 and is positioned between the one bumper member 66 and the cover plate 71 so as to urge the striker bar 30 and rod 65 with associated bumpers 66,67 to the right, as viewed in FIG. 2 so as to hold the striker bar 30 extended and in the latched condition relative to the frame 10 when the door is closed.

The shaft 53 has an enlarged sleeve 78 on one end portion 79 exterior of the door panel 40 so as to limit the axial movement of the shaft 53 with respect to the door panel. The shaft 53 has an undercut slot 82 formed near the other end portion 80 thereof in which slot 82 is seated a U-shaped end 83 of a retaining plate 84 which plate 84 is secured to the side of the base as by a fastener 85. With the end 83 nested in the undercut slot 82, the shoulder on the end 80 of the shaft 53 will prevent the shaft 53 from shifting axially with respect to the door panel 40.

Mounted exteriorly of the door panel 40 and fastened to the end portion 79 of the shaft 53 is the exterior handle or lever 88. The handle 88 is keyed on the shaft 53 so that rotational movement of the handle in either direction will rotate the shaft 53 an equal amount in that direction. Mounted on the inside of the door panel 40 is an internal handle or lever 90 which has an enlarged portion 92 carried by end portion 93 thereof which is secured to the shaft 53 in approximately the same area where the bifurcated lever 60 is connected to the shaft. The interior handle 90 is keyed to the shaft 53 so that movement of the handle will rotate the shaft 53.

Figure 2:
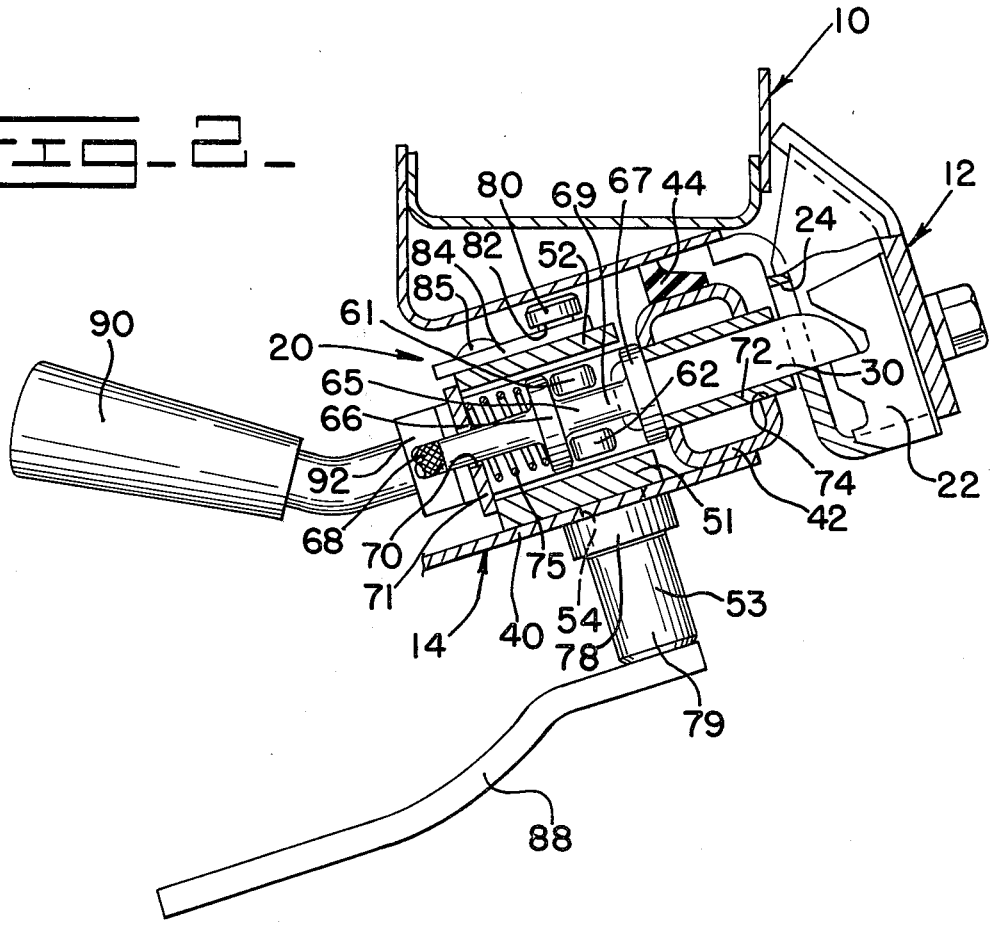
FIG. 2 is a cross-sectional view taken along the lines 2—2 of FIG. 1.

In the normal static condition of the latching device 20, the bifurcated lever 60 has the spaced apart fingers 61,62 straddling the spindle or midportion 69 of the rod 65 in close proximity to the left bumper 66 of the pair of bumpers (as viewed in FIG. 2). The spacing between the front surface of the fingers 61,62 and the other bumper 67 should be approximately equal to the overlap between the striker bar 30 and the indent in the strike portion 12 of the strike plate 22. In this way, the striker bar 30 can be moved axially away from the striker plate 22 by an amount sufficient to release the striker bar 30 from the plate 22 without interference from the bifurcated fingers 61,62 of the lever 60. Therefore, even though the shaft 53 with the affixed handles or levers 88,90 are frozen, wedged or jammed in the latched position, the door can still be released from the inside by the operator by grasping the knurled end 68 of the rod 65 and pulling the strike bar 30 axially to override the actuator so as to release the strike bar 30 from the strike plate 22 permitting the door to open.

In use, the exterior handle 88 can be grapsed and rotated counterclockwise a few degrees which will pivot the shaft 53 to actuate the bifurcated lever 60 causing the fingers 61,62 to engage the bumper 66 to move the rod 65 and striker bar 30 an amount sufficient to unlatch the door from the frame. Likewise, from within the vehicle, the handle 90 can be rotated or depressed in a clockwise direction so as to pivot the shaft 53 and the bifurcated lever 60 so that the fingers 61,62 of the lever 60 will contact the bumper 66 and move the rod 65 and striker bar 30 an amount sufficient to unlatch the door from the frame. In the event either the interior or the exterior levers 88,90 are frozen, jammed or otherwise inoperative, it is still possible for the operator to unlatch the door by grasping the knurled handle portion 68 of the rod 65 and by pulling the striker bar 30 until the bar is released from the latch or striker plate 22. Since the fingers 61,62 of the bifurcated lever 60 are positioned relative to the spaced bumpers 66,67 by an amount sufficient to permit the striker bar 30 to be moved enough to release the striker bar 30 from the striker plate 22, the striker bar 30 can be actuated by, in effect, overriding the actuators normally operated by either or both of the handles 88,90, thereby making it possible for the operator to unlatch the door even though both of the handles 88,90 are ineffective or inoperative.

What is claimed is:

1. In a latch device mounted in a door, a base secured to said door, a shaft rotatably mounted on said base with a portion located inside said door and a portion extending through said door to the exterior thereof, a strike bar slidably carried by said base and extending transverse to the axis of said shaft, spaced abutments radially extending from said strike bar and being located on the strike bar inside said door, a lever keyed to said shaft and having a pair of fingers straddling said strike bar between said spaced abutments, the width of said fingers in the direction of movement of the strike bar being less than the spacing between said abutments, a spring surrounding said strike bar for urging a latch end portion of the strike bar out of the door and into the latched position, the spacing between said fingers on the lever and the abutment on the latch end portion of said strike bar being sufficient to permit the latch bar to be moved to the unlatched position without movement of said lever, exterior handle means keyed to the end portion of said shaft located exterior to said door, interior handle means keyed to the end portion of said shaft located inside the door, whereby pivoting either the interior or exterior handle means will pivot the shaft and the lever to contact one of said abutments to compress the spring and to retract the strike bar into the door, and handle means on said strike bar for moving said strike bar relative to said lever independent of the internal and external handle means for retracting the strike bar from a latched position.

2. In a latch as claimed in claim 1 wherein said spring bears against one of said abutments for urging the strike bar into latching position.

3. In a latch as claimed in claim 2 wherein said handle means is a portion of said strike bar extending from said base in an exposed position for ready access from the inside of said door.

4. In a latch as claimed in claim 1 wherein said interior handle means is keyed to said shaft in the same area as said lever is keyed to said shaft whereby turning said interior handle acts directly to rotate said lever for retracting the strike bar.

* * * * *